US008561993B2

(12) United States Patent
Preston et al.

(10) Patent No.: US 8,561,993 B2
(45) Date of Patent: Oct. 22, 2013

(54) TARGET IMPACT-POINT SENSING SYSTEM

(75) Inventors: Steven Preston, Winter Springs, FL (US); Jan J. Ksel, Casselberry, FL (US); James A. Frey, Ocoee, FL (US)

(73) Assignee: Lockheed Martin Corporation, Bethesda, MD (US)

( * ) Notice: Subject to any disclaimer, the term of this patent is extended or adjusted under 35 U.S.C. 154(b) by 194 days.

(21) Appl. No.: 12/906,590

(22) Filed: Oct. 18, 2010

(65) Prior Publication Data

US 2012/0091660 A1 Apr. 19, 2012

(51) Int. Cl.
*F41J 5/00* (2006.01)

(52) U.S. Cl.
USPC ..... 273/372; 273/348; 273/371; 273/374

(58) Field of Classification Search
USPC ..... 273/348, 371, 372, 374
See application file for complete search history.

(56) References Cited

U.S. PATENT DOCUMENTS

| | | | | |
|---|---|---|---|---|
| 2,939,706 | A * | 6/1960 | Skaredoff | 273/372 |
| 3,479,032 | A * | 11/1969 | Andersson et al. | 273/372 |
| 3,805,030 | A * | 4/1974 | Wichinsky et al. | 377/5 |
| 4,934,937 | A * | 6/1990 | Judd | 434/21 |
| 5,095,433 | A * | 3/1992 | Botarelli et al. | 273/372 |
| 5,320,358 | A * | 6/1994 | Jones | 273/371 |
| 5,447,315 | A * | 9/1995 | Perkins | 273/371 |
| 2003/0109302 | A1 * | 6/2003 | Rist | 463/25 |
| 2005/0091958 | A1 * | 5/2005 | Zehavi et al. | 56/340.1 |
| 2009/0102129 | A1 * | 4/2009 | Isoz et al. | 273/372 |
| 2010/0320691 | A1 * | 12/2010 | McNelis et al. | 273/371 |

OTHER PUBLICATIONS

"Wikipedia Fiberglass". From Wikipedia, The Free Encylopedia. [online], [retrieved on Jan. 3, 2013]. Retrieved from the Internet <URL:http://en.wikipedia.org/wiki/Fiberglass>. 7 pages.*

* cited by examiner

*Primary Examiner* — Lawrence Galka
(74) *Attorney, Agent, or Firm* — Schwegman Lundberg & Woessner, P.A.

(57) ABSTRACT

A target includes multiple segments that are vibrationaly isolated from each other. A vibration sensor is coupled to each segment to provide vibration signatures representative of a segment being impacted by a projectile.

12 Claims, 3 Drawing Sheets

TARGET IMPACT-POINT SENSING SYSTEM

BACKGROUND

Pop-up targets are used in law enforcement and military training to improve the ability of shooters to hit a target in a desired location. Because pop-up targets are very light and flimsy to insure fast response, the whole structure vibrates violently whenever a bullet punctures its surface so that determining the hit point is not practical.

Determination of hit point on a pop-up target is difficult if not impossible in many instances with current sensing techniques. When hit by ballistics, target vibrations set up their own characteristic waveforms associated with the target itself rather than producing characteristic vibrations associated with a bullet passing through the plastic material of the target. The target twists and turns during the impact in a similar manner no matter where the bullet might hit.

Use of supersonic sound sensors allows accurate aim-point to be determined. However, if the projectile is not supersonic there is a problem. For indoor use, placement of shock sensors all over a target can be used, however, in a live fire range, damage to the sensors may be a considerable problem.

SUMMARY

A target includes multiple segments that are vibrationaly isolated from each other. A vibration sensor is coupled to each segment to provide vibration signatures representative of a segment being impacted by a projectile.

In one embodiment, three segments are separated by a slot to provide the vibrational isolation, with a vibration sensor coupled to each segment.

A method includes creating a target in a desired shape out of a material that vibrates when impacted by a projectile. Slots are formed in the target to create segments that are vibrationaly dampened from each other. A vibration sensor is provided for each segment to sense vibrations in each segment resulting from a projectile impact of a section.

DETAILED DESCRIPTION

In the following description, reference is made to the accompanying drawings that form a part hereof, and in which is shown by way of illustration specific embodiments which may be practiced. These embodiments are described in sufficient detail to enable those skilled in the art to practice the invention, and it is to be understood that other embodiments may be utilized and that structural, logical and electrical changes may be made without departing from the scope of the present invention. The following description of example embodiments is, therefore, not to be taken in a limited sense, and the scope of the present invention is defined by the appended claims.

Figure 1:
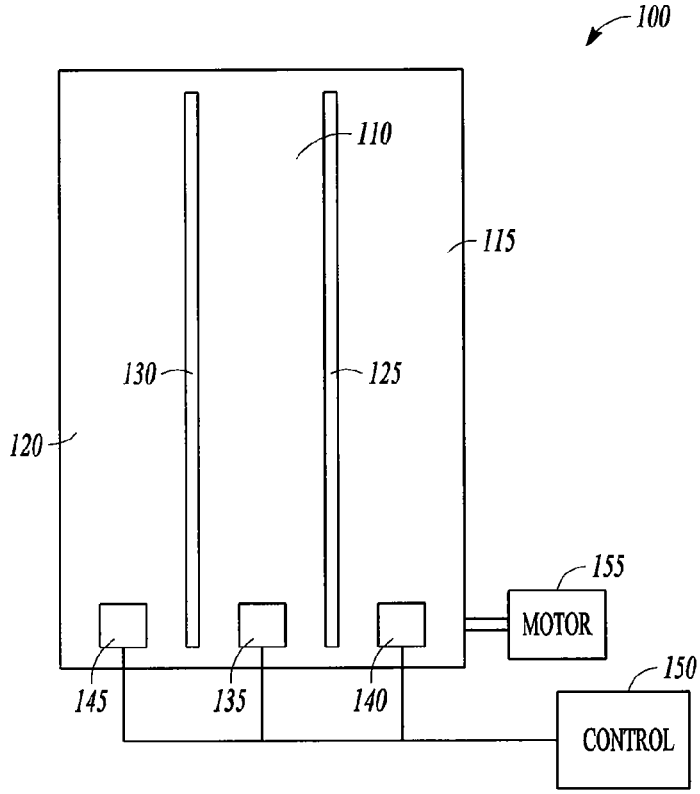
FIG. 1 is a block diagram of a segmented target system according to an example embodiment.

FIG. 1 is a block diagram of a target system 100 used for target practice. The target 100 is segmented. A central area 110 is separated from sides 115 and 120 by slots 125 and 130 respectively to provide three segments. The segments may also be referred to as sectors or sections. Slots 125 and 130 provide separations between segments 110, 115, and 120 that allow three separate vibration tracks to be generated longitudinally along the three harder portions of the target 100. In one embodiment, the slots may run the entire length of the target such that the segments are isolated from each other. The slots in one embodiment are fairly narrow to minimize the chance of a bullet or projectile moving through a slot without an impact being detected, yet wide enough to isolate the segments by vibrationaly decoupling the segments to allow detection of individual segments being impacted.

A vibration sensor 135, 140, and 145 is provided at the base of each segment 110, 115, and 120 respectively in one embodiment to record a vibration signature along each of the three segments. The sensors may be accelerometers in one embodiment, or other type of sensor that can provide amplitude, phase, and timing information regarding their segment. A bullet impact point or hit segment can now be ascertained as a function of the vibration signatures. By locating the sensors at the base of the target, they are less likely to be damage by live gun fire.

Figure 2:
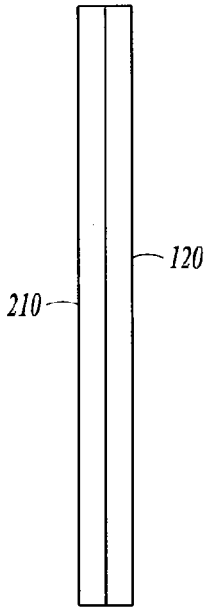
FIG. 2 is a side view of a target according to an example embodiment.

In one embodiment, the segmented target 100 may be reinforced with adhesive material, such as tape on a backside of the target 100, as shown at 210 in FIG. 2, to hold the segments together and provide structural integrity to the target 100 such that it is secure enough to be lifted and remain supported upright during operation. The adhesive material in one embodiment dampens vibrations while reinforcing the structure of the target. The material in one embodiment should inhibit in-phase vibrations between sections.

In some embodiments, an adhesive backed cloth is added back to the target to reestablish a link between the segments and restrict the "twisting" of the segmented target. The cloth material may significantly change the vibration across the slots separating segments so that accelerometers or acoustic sensors 135, 140, and 145 at the base of each section can differentiate the sector causing the most vibration and whose vibration phase shift is different from the other two sectors or segments not impacted.

By placing the sensors at the base of the segmented target 100, the possibility of a sensor being damaged is minimized, while still facilitating hit position to be registered. Sensor may of course be placed in other positions on the target as desired in further embodiments to detect vibrations. The segmented target with sensors may be constructed in a manner less expensive than a supersonic wave sensor. The segmented target need not change the shape of a non-instrumented aim-point sensing target, providing design freedom in constructing targets. The target may have the sensors at the base of the target and may be further protected by a covering burm.

In one embodiment, the sensors provide vibration signals when a segment is impacted. The sensors may provide amplitude, phase, and timing information to a controller 150, such as circuitry or a processor to determine the hit segment. The controller 150 may also provide instructions to a motor 155 coupled to the target to drop the target as a function of the hit. A hit on section 110 in one embodiment would cause the target to drop, while one hit on 115 or 120 may not cause the target to drop. Multiple hits may also cause the target to drop if desired. The types and combinations of hits that would cause the target to drop may be varied as desired. The controller 150 may also be networked to a central controller that controls multiple targets, and may be raised or dropped under conditions set by the central controller.

Figure 3:
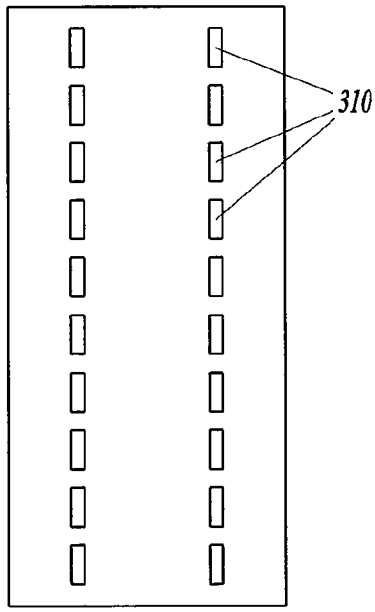
FIG. 3 is a bock diagram view of a target with perforated slots according to an example embodiment.

In further embodiments, the slots may have a perforated structure as shown at 310 in FIG. 3 that minimizes vibrations transmitted from one segment to another, or changes the transmitted vibrations significantly such that vibration signatures may be distinguished between a segment being directly hit from vibration signatures resulting from a different segment being hit. In one embodiment, the slots extend the entire length of the target except at least a portion at or near the top of the target to provide some structural integrity. The slot may also extend almost to the bottom of the target. In yet a further embodiment, the segments may be joined with a rubber or other vibration damping material to provide structurally integrity between segments without transmitting vibrations that might interfere with detection of vibrations of the segment impacted. In yet a further embodiment, the slots may be a thinning of the material between the segments. The slots are thinned sufficiently to provide a vibration isolation that allows identification of a hit segment via the sensor vibration signals.

In still further embodiments, more than three segments may be provided, or a target may be segmented in two segments. The slots may be formed as parallel vertical slots, segmenting the target into vertical segments in one embodiment. In further embodiments, the slots may be formed to divide a target up into critical hit areas, and non-critical hit areas. Generally, the torso and head are critical hit areas for human shaped targets, and may be included in one segment. A portion of the legs of the target may be included to extend the segment to the base of the target where a sensor may be located in some embodiments. In further embodiments, segments need not be extended to the base, and sensors may be located to obtain vibration signatures from the segments.

Figure 4:
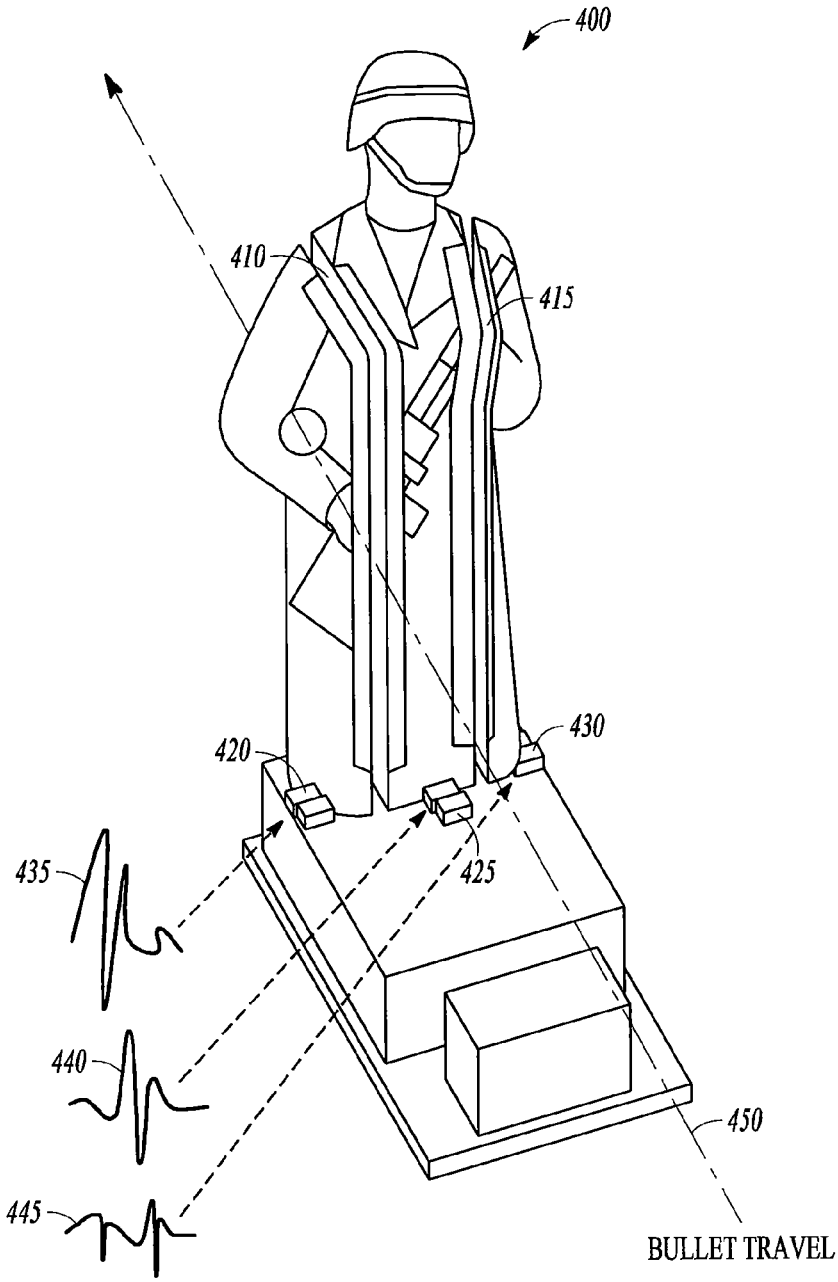
FIG. 4 is a perspective view of a target according to an example embodiment.

FIG. 4 is a perspective view of a target 400 with slots 410, 415. Target 400 may be essentially two-dimensional or three-dimensional as shown. Target 400 is formed in the shape of a soldier and has acoustic sensors 420, 425, 430 positioned at a base of three sections formed by the slots. Acoustic signatures for left, middle, and right sections are shown at 435, 440, and 445 for a bullet 450 strike to the left section. There is a noticeable difference in the amplitude, phase, and timing of the signatures, allowing identification of the section hit. The signature 435 corresponding to the hit section has larger amplitude and occurs first in time when compared to the other signatures. The phase is also different as seen.

Figure 5:
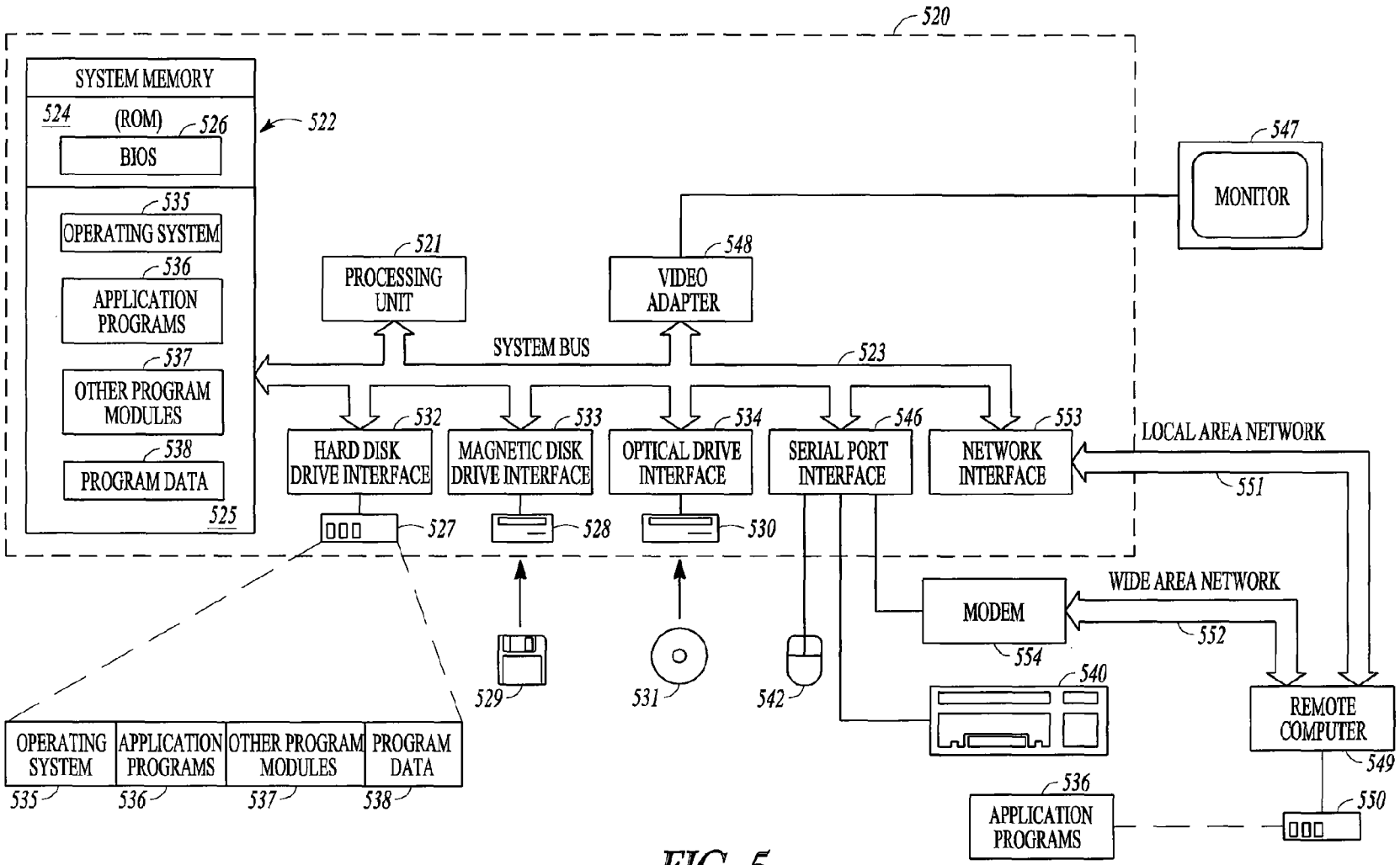
FIG. 5 is a block diagram view of a computer system for processing data obtained from sensors according to an example embodiment.

In the embodiment shown in FIG. 5, a hardware and operating environment is provided that may be used to execute algorithms to analyze the vibration signatures to determine which segment is impacted and to instruct the motor to drop the target responsive to the signatures.

As shown in FIG. 5, one embodiment of the hardware and operating environment includes a general purpose computing device in the form of a computer 520 (e.g., a personal computer, workstation, or server), including one or more processing units 521, a system memory 522, and a system bus 523 that operatively couples various system components including the system memory 522 to the processing unit 521. There may be only one or there may be more than one processing unit 521, such that the processor of computer 520 comprises a single central-processing unit (CPU), or a plurality of processing units, commonly referred to as a multiprocessor or parallel-processor environment. In various embodiments, computer 520 is a conventional computer, a distributed computer, or any other type of computer.

The system bus 523 can be any of several types of bus structures including a memory bus or memory controller, a peripheral bus, and a local bus using any of a variety of bus architectures. The system memory can also be referred to as simply the memory, and, in some embodiments, includes read-only memory (ROM) 524 and random-access memory (RAM) 525. A basic input/output system (BIOS) program 526, containing the basic routines that help to transfer information between elements within the computer 520, such as during start-up, may be stored in ROM 524. The computer 520 further includes a hard disk drive 527 for reading from and writing to a hard disk, not shown, a magnetic disk drive 528 for reading from or writing to a removable magnetic disk 529, and an optical disk drive 530 for reading from or writing to a removable optical disk 531 such as a CD ROM or other optical media.

The hard disk drive 527, magnetic disk drive 528, and optical disk drive 530 couple with a hard disk drive interface 532, a magnetic disk drive interface 533, and an optical disk drive interface 534, respectively. The drives and their associated computer-readable media provide non volatile storage of computer-readable instructions, data structures, program modules and other data for the computer 520. It should be appreciated by those skilled in the art that any type of computer-readable media which can store data that is accessible by a computer, such as magnetic cassettes, flash memory cards, digital video disks, Bernoulli cartridges, random access memories (RAMs), read only memories (ROMs), redundant arrays of independent disks (e.g., RAID storage devices) and the like, can be used in the exemplary operating environment.

A plurality of program modules can be stored on the hard disk, magnetic disk 529, optical disk 531, ROM 524, or RAM 525, including an operating system 535, one or more application programs 536, other program modules 537, and program data 538. Programming for implementing one or more processes or method described herein may be resident on any one or number of these computer-readable media.

A user may enter commands and information into computer 520 through input devices such as a keyboard 540 and pointing device 542. Other input devices (not shown) can include a microphone, joystick, game pad, satellite dish, scanner, or the like. These other input devices are often connected to the processing unit 521 through a serial port interface 546 that is coupled to the system bus 523, but can be connected by other interfaces, such as a parallel port, game port, or a universal serial bus (USB). A monitor 547 or other type of display device can also be connected to the system bus 523 via an interface, such as a video adapter 548. The monitor 547 can display a graphical user interface for the user. In addition to the monitor 547, computers typically include other peripheral output devices (not shown), such as speakers and printers.

The computer 520 may operate in a networked environment using logical connections to one or more remote computers or servers, such as remote computer 549. These logical connections are achieved by a communication device coupled to or a part of the computer 520; the invention is not limited to a particular type of communications device. The remote computer 549 can be another computer, a server, a router, a network PC, a client, a peer device or other common network node, and typically includes many or all of the elements described above I/O relative to the computer 520, although only a memory storage device 550 has been illustrated. The logical connections depicted in FIG. 5 include a local area network (LAN) 551 and/or a wide area network (WAN) 552. Such networking environments are commonplace in office networks, enterprise-wide computer networks, intranets and the internet, which are all types of networks.

When used in a LAN-networking environment, the computer 520 is connected to the LAN 551 through a network interface or adapter 553, which is one type of communications device. In some embodiments, when used in a WAN-networking environment, the computer 520 typically includes a modem 554 (another type of communications device) or any other type of communications device, e.g., a wireless transceiver, for establishing communications over the wide-area network 552, such as the internet. The modem 554, which may be internal or external, is connected to the system bus 523 via the serial port interface 546. In a networked environment, program modules depicted relative to the computer 520 can be stored in the remote memory storage device 550 of remote computer, or server 549. It is appreciated that the network connections shown are exemplary and other means of, and communications devices for, establishing a communications link between the computers may be used including hybrid fiber-coax connections, T1-T3 lines, DSL's, OC-3 and/or OC-12, TCP/IP, microwave, wireless application protocol, and any other electronic media through any suitable switches, routers, outlets and power lines, as the same are known and understood by one of ordinary skill in the art.

The Abstract is provided to comply with 37 C.F.R. §1.72(b) is submitted with the understanding that it will not be used to interpret or limit the scope or meaning of the claims.

The invention claimed is:

1. A target comprising:

multiple vibrationaly isolated segments forming a target shape with slots between the segments;

vibrational-dampening material disposed across the slots to provide structural integrity between the segments without transmitting hit detection interfering vibrations; and a vibration sensor coupled to each segment, wherein the vibration sensors provide a vibration signature from each segment representative of whether the segment has been impacted by a projectile; and a controller to receive the vibration signatures and determine which segment has been impacted by the projectile, and a motor coupled to the segments, wherein the controller instructs the motor to drop the segments when an impact of at least one predetermined segment is detected.

2. The target of claim 1 wherein the vibrational-dampening material comprises an adhesive material on a backside of the segments.

3. The target of claim 1 wherein the vibration signatures include amplitude, phase, and timing information of vibrations of the respective segments.

4. The target of claim 1 and further comprising a reinforcing material coupling the segments to each other.

5. The target of claim 4 wherein the reinforcing material is an adhesive backed fabric.

6. The target of claim 1 wherein slots run vertically between segments and are extend from near a top of the target to near a bottom of the target.

7. A target system comprising:

a first segment extending from a base;

a second segment extending from a base adjacent the first segment;

a third segment extending from a base adjacent to the second segment;

a first vibration sensor coupled to the first segment at the base;

a second vibration sensor coupled to the second segment at the base;

a third vibration sensor coupled to the third segment at the base, wherein the segments are at least partially vibrationaly isolated from each other by slots such that the vibration sensors sense vibrations that distinguish which segment has been impacted by a projectile, and wherein a vibrational-dampening material is disposed between the segments to provide structural integrity without transmitting hit detection interfering vibrations between the segments; and a controller to receive vibration signatures corresponding to the sensed vibrations to determine which segment has been impacted by the projectile; and a motor coupled to the segments, wherein the controller instructs the motor to drop the segments when an impact of at least one predetermined segment is detected.

8. The target system of claim 7 wherein the vibration signatures include amplitude, phase, and timing information of vibrations of the respective segments.

9. The target system of claim 8 wherein the vibrational-dampening material is an adhesive backed fabric that dampens vibrations between segments and provides structural integrity to the segments.

10. A method comprising:

creating a target in a desired shape out of a material that vibrates when impacted by a projectile;

forming slots in the target to create segments that are vibrationaly dampened from each other;

joining the slots with a material to provide structural integrity of the target without transmitting hit detection interfering vibrations between segments;

providing a vibration sensor for each segment to sense vibrations in each segment resulting from a projectile impact of a section; and dropping the target when a predetermined segment is detected as being directly impacted by a projectile.

11. The method of claim 10 wherein the target is formed in the shape of a human body and the predetermined segment is representative of sensitive areas of a human body.

12. The method of claim 10 and further comprising coupling the segments with an adhesive backed material to provide structurally integrity to the target.

* * * * *